US005988709A

United States Patent [19]

Lee et al.

[11] Patent Number: 5,988,709

[45] Date of Patent: Nov. 23, 1999

[54] OPENING AND CLOSING DEVICE OF A REFRIGERATOR DOOR

[75] Inventors: Young Gunw Lee; Jin Woo Song, both of Seoul, Rep. of Korea

[73] Assignee: Daewoo Electronics Co., Ltd., Seoul, Rep. of Korea

[21] Appl. No.: 09/146,538

[22] Filed: Sep. 3, 1998

[30] Foreign Application Priority Data

Sep. 8, 1997 [KR] Rep. of Korea ..... 97-46218

[51] Int. Cl.[6] ..... E05C 3/06

[52] U.S. Cl. ..... 292/199; 292/51; 292/DIG. 71

[58] Field of Search ..... 292/199–210, 292/211, 219, 220, 224, 228, 51, 124, 127, 98, 99, DIG. 71; 312/401, 405, 212, 222, 296

[56] References Cited

U.S. PATENT DOCUMENTS

| | | | |
|---|---|---|---|
| 1,081,634 | 12/1913 | Smith . | |
| 1,213,651 | 1/1917 | Johns . | |
| 1,272,327 | 7/1918 | Bisaillon . | |
| 1,540,088 | 6/1925 | Rasmussen . | |
| 1,542,092 | 6/1925 | Rasmussen . | |
| 1,661,548 | 3/1928 | Stuart et al. . | |
| 2,922,673 | 1/1960 | Riley . | |
| 3,339,956 | 9/1967 | Bencene et al. . | |
| 3,794,365 | 2/1974 | Richberg | 292/62 |
| 4,170,848 | 10/1979 | Taniwaki | 49/358 |
| 5,269,573 | 12/1993 | Rear | 292/257 |

*Primary Examiner*—Flemming Saether
*Assistant Examiner*—Teri Pham
*Attorney, Agent, or Firm*—Pennie & Edmonds LLP

[57] ABSTRACT

An opening and closing device of a refrigerator door includes a button, a gear, a cam, an arm, a push panel, and a plurality of stoppers. The button has a gear portion formed vertically on one side thereof and a top portion protruding above a top surface of the door. The gear is engaged with the gear portion of the button. The cam is integrally formed on the gear and fixed on a same shaft as the gear. The arm has a top surface of a rear portion thereof coming in contact with the cam and a front end including a hook, rotatably mounted on the refrigerator door. The push panel has a depression for engaging with the hook of the arm, mounted on the body of the refrigerator and capable of being rotated by a spring. The plurality of stoppers restrict the rotation of the push panel and they are mounted near and on one side of the push panel.

5 Claims, 3 Drawing Sheets

OPENING AND CLOSING DEVICE OF A REFRIGERATOR DOOR

FIELD OF THE INVENTION

The present invention relates to a refrigerator; and, more particularly, to a device for making opening and closing a refrigerator door simple, correct and easy.

BACKGROUND OF THE INVENTION

In a refrigerator, as shown in FIG. 1, a gasket 300 is placed between a door 100 and a body 200 thereof to prevent the outflowing of cool air and inflowing of warm air therefrom and thereinto by filling a gap between the body 200 and the door 100. Further, a permanent magnet 310 is placed inside the gasket 300 to force the gasket 300 to closely adhere to the body 200 by the magnetic force and improve the sealing capability of the gasket 300.

However, in such a refrigerator, it requires a large force to open the door, the force being large enough to overcome the magnetic force of the magnet and the weight of the door.

SUMMARY OF THE INVENTION

It is, therefore, a primary object of the present invention to provide an opening and closing device to be incorporated in a refrigerator door to make the opening and closing thereof simple, correct and easy.

The above and other objects of the present invention are accomplished by providing an opening and closing device for a refrigerator door, the device comprising: a button having a gear portion formed vertically on one side thereof and a top portion protruding above a top surface of the refrigerator door; a gear engaged with the gear portion of the button; a cam integrally formed on the gear and fixed on a same shaft as the gear; an arm having a top surface of a rear portion thereof coming in contact with the cam and a front portion including a hook, rotatably mounted on the refrigerator door; a push panel having a depression for engaging with the hook of the arm, mounted on the body of the refrigerator and capable of being rotated by a spring; and a plurality of stoppers for restricting the rotation of the push panel and mounted near and on one side of the push panel.

BRIEF DESCRIPTION OF THE DRAWINGS

The above and other objects and features of the instant invention will become apparent from the following description of preferred embodiment taken in conjunction with the accompanying drawings, in which.

DETAILED DESCRIPTION OF THE PREFERRED EMBODIMENT

Figure 1:
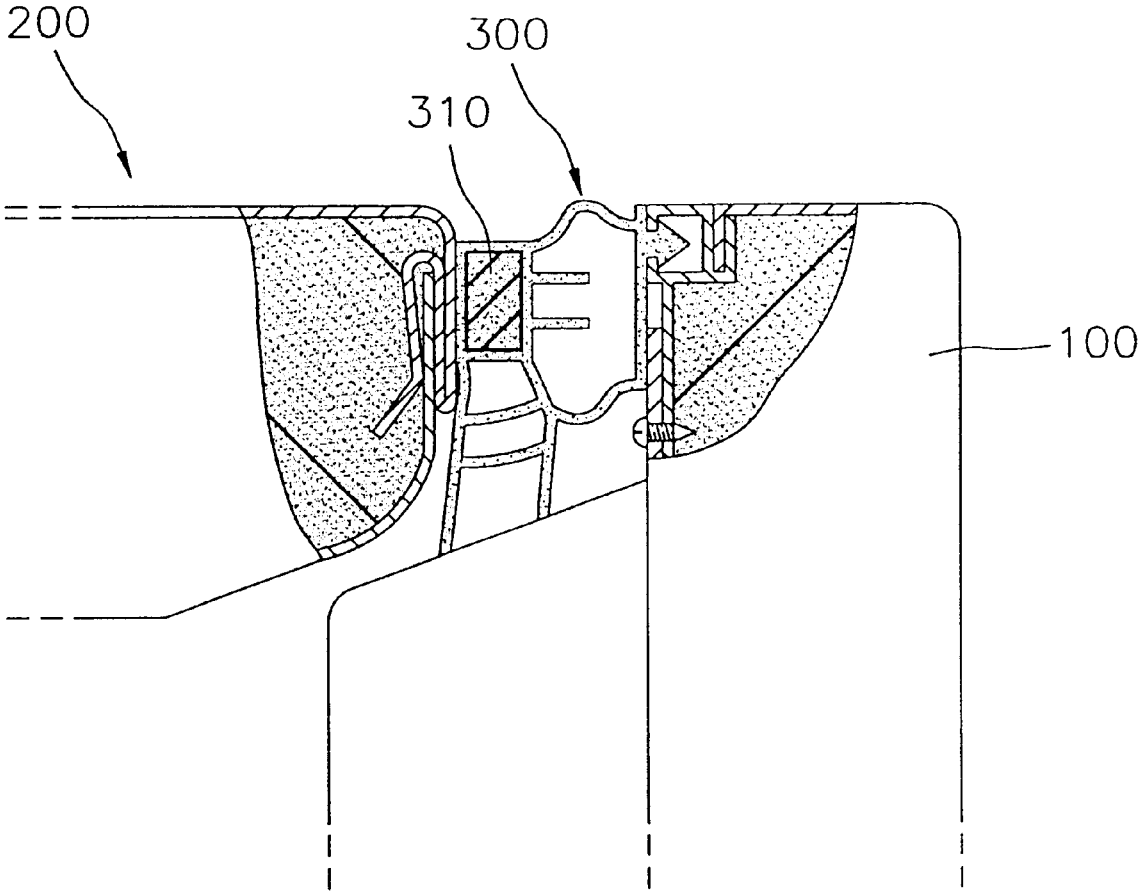
FIG. 1 (PRIOR ART)
FIG. 1 illustrates a schematic view of a prior art refrigerator.
Figure 2:
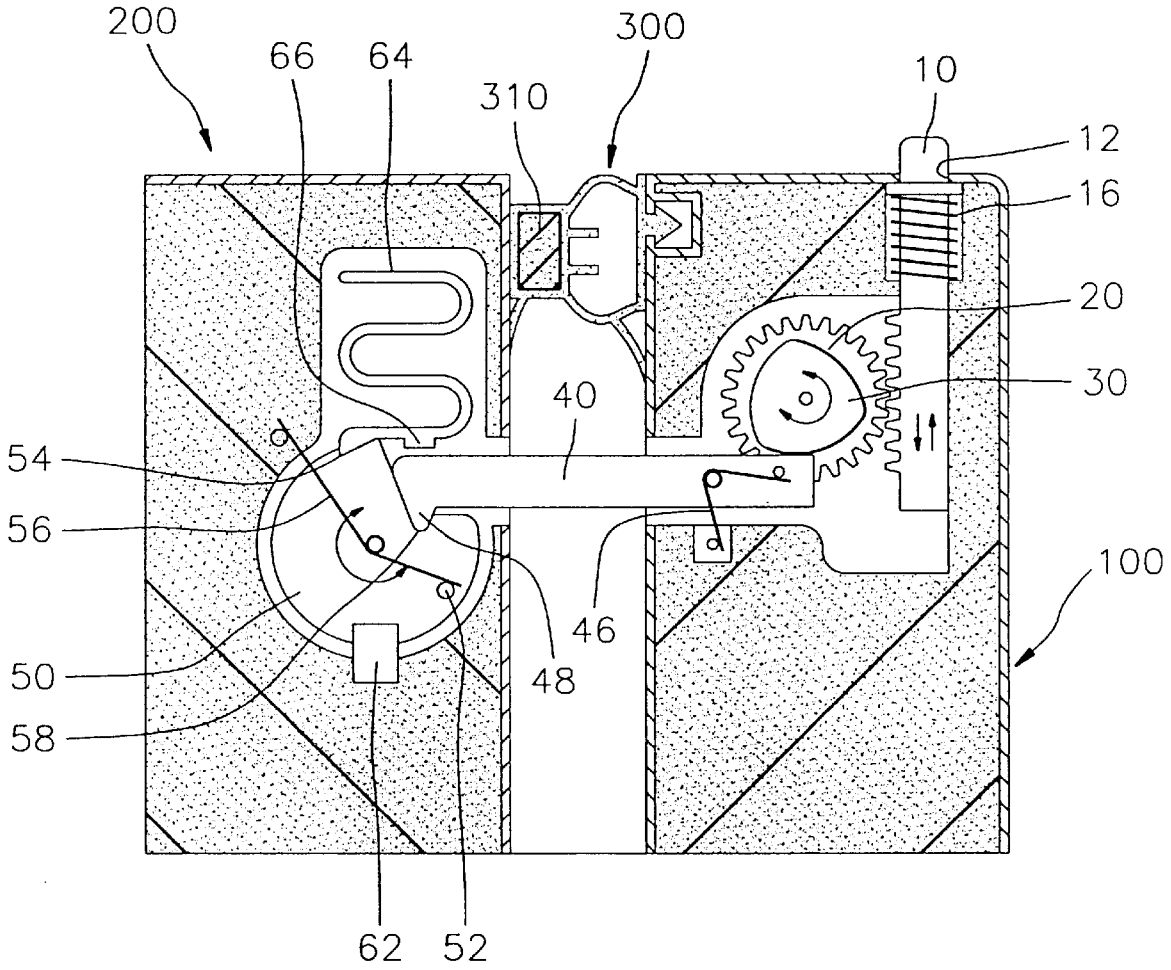
FIG. 2 is a sectional view of a refrigerator in accordance with a present invention.
Figure 3:
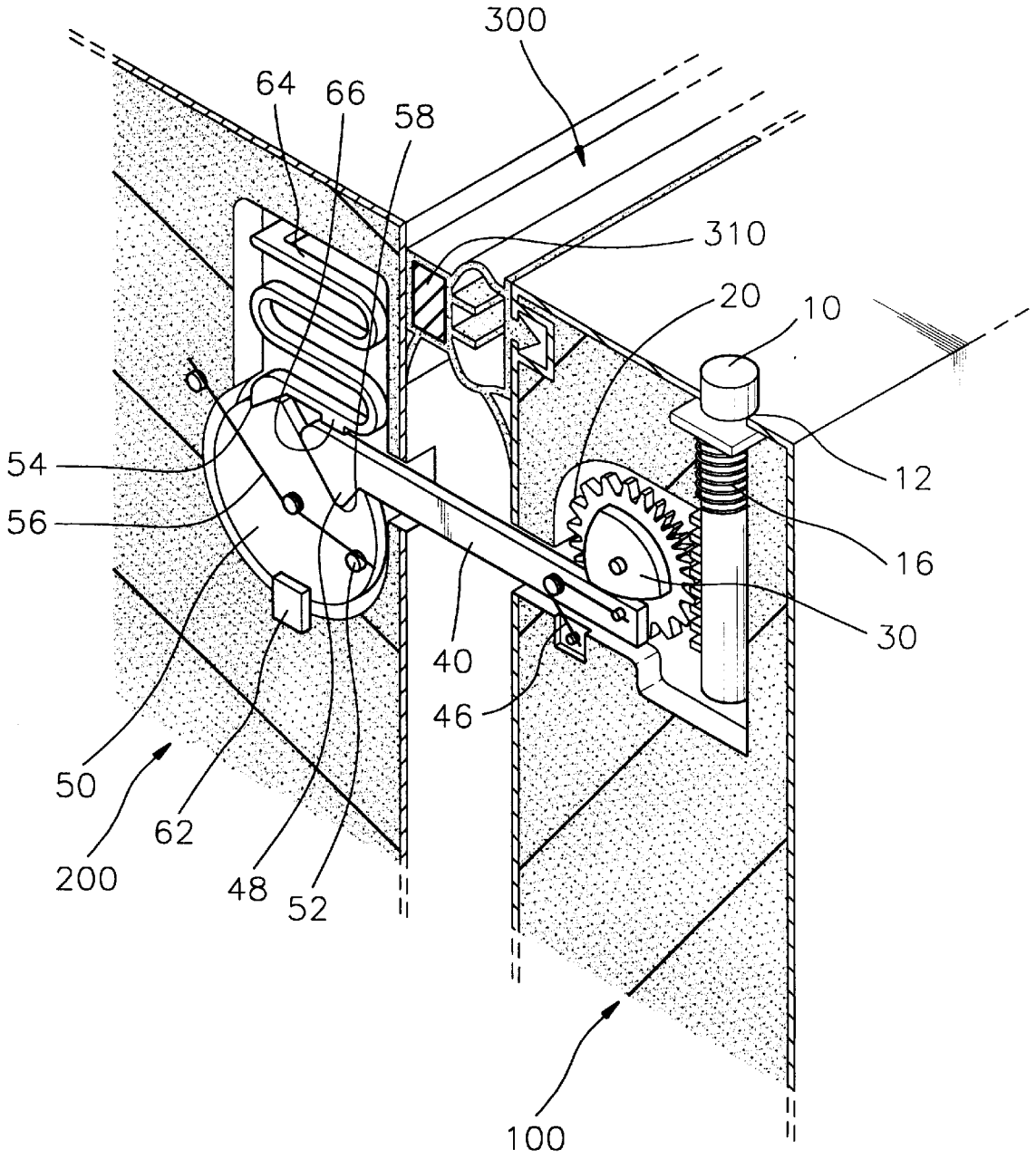
FIG. 3 presents a schematic view of a refrigerator in accordance with the present invention.

As shown in FIGS. 2 and 3, a gasket 300 is placed between a door 100 and a body 200 of a refrigerator to fill a gap therebetween. Further, a permanent magnet 310 is placed inside the gasket 300 to enhance the adhesion between the gasket 300 and the body 200.

An opening and closing device in accordance with a preferred embodiment of the present invention is disposed at an inner part of the gasket 300 near a top part of the door 100, and at an inner part of the body 200 facing the gasket 300, respectively.

The opening and closing device in accordance with the preferred embodiment of the present invention includes a button 10, a gear 20, a cam 30, an arm 40, a push panel 50, and a plurality of stoppers.

The button 10 placed in a hole 12 near the top part of the refrigerator door 100 includes a gear portion formed vertically on one side thereof and a top portion protruding above a top surface of the refrigerator door 100 and is capable of moving up and down the hole 12. The button 10 moves down the hole 12 when the user pushes down the top portion thereof and moves up the hole 12 by the elastic force of a compression spring 16 placed inside the hole 12.

The gear 20 disposed at one side of the button 10 rotates when it engage with the gear portion of the button 10.

The cam 30 is integrally formed on one side of the gear 20 and is fixed on a same shaft as the gear 20.

The arm 40 has a top surface of one end thereof coming in contact with the cam 30 and one side of the other end thereof includes a hook 48. A torsion spring 46 located at one side of the end coming in contact with the cam 30 provides an elastic force to move the end upward, i.e., in a counterclockwise direction.

The push panel 50, having a first depression 58 for hooking the hook 48 of the arm 40, is rotatably mounted at the inner part of the body 200 and elastically forced to a clockwise direction by a second torsion spring 56.

A second depression 54 on the push panel 50, an elastic stopper 64, a panel stopper 52 and a fixed stopper 62 function as the stoppers.

The elastic stopper 64 is located near the second depression 54 formed on the push panel 50, the end portion thereof engaging the second depression 54. Further, the elastic stopper 64 has a protrusion 66 facing a side of the arm 40 opposite from the side where the hook 48 is located. When the arm 40 rotates clockwise, the end portion of the elastic stopper 64 gets disengaged from the second depression 54.

The rotational movement of the panel stopper 52 protruding from one side of the push panel 50, and hence the push panel 50, limited by the presence of the fixed stopper 62.

When the door 100 is in a closed state, the hook 48 of the arm 40 is engaged with the first depression 58 of the push panel 50, allowing the refrigerator door 100 to be firmly closed.

The opening process of the refrigerator door 100 is as follows. The refrigerator door 100 can be simply pushed and opened simply by pressing down the button 10.

When the button 10 is pressed down, it forces the gear 20 and cam 30 to rotate, the rotation of the cam 30, in turn, causing the top surface of one end of the arm 40 to press down.

When the cam 30 presses the top surface of one end of the arm 40, the arm 40 rotates clockwise by pressing down one end of the spring 46, which, in turn, pushes up the protrusion 66 of the elastic stopper 64, forcing the end portion of the elastic stopper 64 to be disengaged, allowing the push panel 50 to be rotated clockwise by the torsion spring 56. The clockwise rotation of the push panel 50 pushing out the arm 40. The panel stopper 52 and the fixed stopper 62 prevents the push panel 50 from overrotating.

When the compression force pushing down the button 10 is removed, the end of the arm 40 coming in contact with the cam 30 moves upward by the elastic force of the spring 46 and the compression spring 16 forces up the button 10 along the hole 12, thereby returning the button 10 to its original position.

In closing the door 100, the front end of the arm 40 pushes the inner surface of the first depression 58 on the push panel 50, which, in turn, rotates the push panel 50 counterclockwise until the hook 48 of the arm 40 and the elastic stopper 64 becomes engaged with the first depression 58 of the push panel 50 and the second depression 54, respectively, forcing the gasket 300 mounted on the refrigerator door 100 to closely adhere to the inner part of the body 200.

Using the inventive device, it is easy to determine whether or not the refrigerator door 100 is closed firmly. If the refrigerator door 100 is not firmly closed, the end portion of the stopper 64 does not get engaged with the second depression 54, forcing the arm 40 to be pushed out resulting from the second spring 56 forcing clockwise rotation of the push panel 50, which, in turn, opens the refrigerator door 100.

Consequently, the opening and closing device of a refrigerator door in accordance with the preferred embodiment of the present invention makes the opening and closing operations simple, correct and easy.

Although the invention has been shown and described with respect to the preferred embodiment, it will be understood by those skilled in the art that various changes and modifications may be made without departing from the spirit and scope of the invention as defined in the following claims.

What is claimed is:

1. A refrigerator having a door and a body said refrigerator door incorporating therein an opening and closing device, the device comprising:

a button having a gear portion formed vertically on one side thereof and a top portion protruding above a top surface of the refrigerator door;

a gear engaged with the gear portion of the button;

a cam integrally formed on the gear and fixed on a same shaft as the gear;

an arm having a top surface of a rear portion thereof coming in contact with the cam and a front end including a hook, rotatably mounted on the refrigerator door;

an elastic stopper mounted on the body of the refrigerator;

a push panel having a first depression and a second depression for engaging with the hook of the arm and the end portion of the elastic stopper, respectively, mounted on the body of the refrigerator and capable of being rotated by a spring; and a plurality of stoppers for restricting the rotation of the push panel and mounted near and on one side of the push panel.

2. The refrigerator according to claim 1, wherein the button is forced upward by a compression spring.

3. The refrigerator according to claim 1, wherein the plurality of stoppers include a panel stopper protruding from one side of the push panel and a fixed stopper corresponding to the panel stopper mounted near the panel stopper on the body of the refrigerator, the panel stopper and fixed stopper restricting the rotation angle of the push panel during the refrigerator door opening.

4. The refrigerator according to claim 1, wherein the elastic stopper has a protrusion facing a side of the arm opposite from the side where the hook is formed.

5. A opening and closing device for a door mounted on a door frame, the device comprising:

a button having a gear portion formed vertically on one side thereof and a top portion protruding above a top surface of the door;

a gear engaged with the gear portion of the button;

a cam integrally formed on the gear and fixed on a same shaft as the gear;

an arm having a top surface of a rear portion thereof coming in contact with the cam and a front end including a hook, rotatably mounted on the door;

an elastic stopper mounted on the door frame;

a push panel having a first depression and a second depression for engaging with the hook of the arm and the end portion of the elastic stopper, respectively, mounted on the door frame and capable of being rotated by a spring; and a plurality of stoppers for restricting the rotation of the push panel and mounted near and on one side of the push panel.

* * * * *